US005185614A

United States Patent [19]

Courian et al.

[11] Patent Number: 5,185,614

[45] Date of Patent: Feb. 9, 1993

[54] PRIMING APPARATUS AND PROCESS FOR MULTI-COLOR INK-JET PENS

[75] Inventors: Kenneth J. Courian, San Diego, Calif.; Roger F. Evans, Corvallis, Oreg.

[73] Assignee: Hewlett-Packard Company, Palo Alto, Calif.

[21] Appl. No.: 686,740

[22] Filed: Apr. 17, 1991

[51] Int. Cl.[5] ..... B41J 2/165; B41J 2/21

[52] U.S. Cl. ..... 346/1.1; 346/140 R

[58] Field of Search ..... 346/140 R, 1.1, 75

[56] References Cited

U.S. PATENT DOCUMENTS

| | | | |
|---|---|---|---|
| 4,123,761 | 10/1978 | Kimura | 346/140 R |
| 4,492,969 | 1/1985 | Terasawa | 346/140 R |
| 4,510,510 | 4/1985 | Terasawa | 346/140 R |
| 4,727,378 | 2/1988 | Le et al. | 346/1.1 |
| 4,952,947 | 8/1990 | Kyoshima | 346/140 R |

OTHER PUBLICATIONS

Ink Retention in a Color Thermal Inkjet Pen, Hewlett-Packard Journal, Aug. 1988, E. Erturk et al., pp. 41-44.

*Primary Examiner*—Joseph W. Hartary

[57] ABSTRACT

Multi-color ink-jet pens having an orifice set associated with each color are primed by an apparatus that avoids mixing of two colors during priming. A resilient seal forms a chamber that encloses the orifice sets. The chamber is connected to a vacuum source to reduce the pressure in the chamber for drawing ink out of the orifices. A set of suction tubes connects to the vacuum source, with each tube terminating within the chamber in closely spaced relation with a corresponding orifice set for drawing excess ink away from the orifice set, thereby preventing the various colors of primed ink from mixing.

17 Claims, 4 Drawing Sheets

PRIMING APPARATUS AND PROCESS FOR MULTI-COLOR INK-JET PENS

TECHNICAL FIELD

This invention relates to mechanisms for priming multi-color pens used in ink-jet printing.

BACKGROUND INFORMATION

Pens used for ink-jet printing generally include an ink supply housed within the pen. The ink supply is in fluid communication with a set of orifices formed in an orifice plate that is mounted to the pen. A print head mechanism is controlled for forcing drops of ink through the orifice set as the pen is moved relative to a printing medium, such as paper. One such print head mechanism, known as a thermal bubble-type, includes a thin-film resistor associated with each orifice. The resistor is heated to cause sudden vaporization of a small amount of the ink near an orifice. The rapid expansion of the ink vapor forces an ink drop through the orifice.

The ink supply for ink-jet pens is normally stored in a manner such that ink does not leak out of the orifices whenever the print head mechanism is inactive. In this regard, the ink may be stored in a compartment filled with open-cell foam so that the capillarity of the foam prevents the flow of ink out of orifices in the absence of the force generated by the activated print head mechanism for expelling drops.

The mechanism for storing ink so that the ink does not leak from orifices when the print head mechanism is inactive may be different from one pen design to another. Irrespective of the particular storage mechanism used, however, there will be established in the ink storage or supply compartment a back pressure sufficient for resisting ink leakage whenever the print head mechanism is inactive. This back pressure holds ink at the orifice plate to define in each orifice an ink/air interface near the outer surface of the orifice plate. The print head mechanism overcomes the back pressure in ejecting ink from the orifices.

An ink-jet pen, such as the thermal bubble-type just described, will not operate properly unless there exists between the ink supply compartment and the orifice set a continuous path of ink. Put another way, a filled pen must be primed by forcing ink from the supply compartment to the orifice set to eliminate any air that may be present between the ink supply and the orifice set.

A conventional way to prime an ink-jet pen is to place the orifice set in fluid communication with a vacuum source for a time sufficient for drawing ink from the supply compartment and out through the orifice set.

Multi-color ink-jet pens typically include three ink supply compartments, each compartment storing a specific color of ink. Each ink supply compartment is in fluid communication with an associated set of orifices so that one set of orifices ejects ink drops of a specific color. The three ink colors may be, for example, cyan, yellow, and magenta, and may be selectively applied to a printing medium to generate any of a multitude of colors through the process of subtractive color mixing.

In order to ensure reliable color printing, it is important that an ink color associated with one orifice set does not mix with the colored ink of another orifice set prior to reaching the printing medium. Such undesirable mixing of one ink color with another ink color is likely to occur as a result of the priming process mentioned above. In this regard, some of the ink drawn from an ink supply compartment through an associated orifice set during priming may move out of the orifice set and flow along the outer surface of the orifice plate to a location near an orifice set of another color ink. When the priming force (suction) is removed, ink of one color may be drawn into the adjacent orifice set of another color by the back pressure established in the ink supply compartment.

When two colors of ink mix in a single orifice set and are thereafter ejected by the print head, the resultant printed color is not that specified to the printer. Consequently, color print quality suffers until all of the mixed ink is ejected from the orifice set.

In the past, the orifice sets of multi-color ink-jet pens were spaced far enough apart so that during the priming process ink of one color was unlikely to flow along the orifice plate outer surface for a distance sufficient to contact and mix with another color ink.

A prior art ink-jet pen and priming mechanism is depicted schematically in FIG. 1 and includes a multi-color ink-jet pen 20 divided into a cyan-ink supply compartment 22, a magenta-ink supply compartment 24, and a yellow-ink supply compartment 26.

The cyan-ink compartment 22 supplies ink to an associated orifice set 28 formed in an orifice plate 40 that is mounted to the underside of the pen 20. The magenta-ink compartment 24 supplies ink to a second orifice set 30 in plate 40. The yellow-ink compartment 26 supplies ink to a third orifice set 32 in plate 40. The ink in each supply compartment is stored in an open-cell foam medium 27, which medium provides capillarity sufficient for preventing ink from leaking through orifices whenever a print head mechanism associated with each orifice (not shown) is inactive. Accordingly, the capillarity of the foam in each supply compartment 22, 24, 26 establishes a back pressure sufficient for preventing leakage of ink through the associated orifice sets 28, 30, 32.

The prior priming apparatus 34 (FIG. 1) comprises a flexible connector member 36 that is movable against the outer surface 38 of the orifice plate 40. The connector member 36 is shaped to define a substantially sealed priming chamber 42. The priming chamber 42 is placed in fluid communication with a vacuum source 44. Once each ink compartment 22, 24, 26 is filled with ink, the connector member 36 is moved against the orifice plate 40 and a partial vacuum is established within the priming chamber 42 by the vacuum source 44. Ink is, therefore, drawn from each ink supply compartment through an associated orifice set 28, 30, 32. Ink drawn out of an orifice set flows toward the vacuum source 42 to be trapped and disposed of. After a time sufficient for drawing the ink in each compartment through each associated orifice set, the vacuum is removed and the back pressure within each supply compartment thereafter prevents ink from leaking from the orifice sets.

As mentioned above, prior ink-jet pen designs are such that the minimum distance "d" (FIG. 1) between any two orifice sets is great enough so that any ink residing on the outer surface 38 of the orifice plate 40 after the priming process is unlikely to flow the distance "d" to an adjacent orifice set and cause the undesirable mixing mentioned above. As an added measure for preventing printing problems where mixing may occur, the pen is operated for a short time to expel any mixed ink before the pen is packaged for sale.

Current designs of orifice plates for multi-color ink-jet pens have substantially reduced the minimum distance between orifice sets. Accordingly, the likelihood of color mixing as a result of the priming process is increased since residual ink on the orifice plate outer surface need travel only a short distance before mixing with a color of an adjacent orifice set. Expelling mixed ink prior to pen packaging is unacceptable because of the attendant waste of ink. Moreover, mixed ink tends to rapidly disperse into the ink supply, thereby making it difficult to efficiently expel all of the mixed ink prior to packaging.

SUMMARY OF THE INVENTION

This invention is directed to a priming apparatus and process for multi-color ink-jet pens that provides effective priming of each orifice set in a multi-color pen without mixing colors, and that minimizes the amount of ink wasted during the priming process.

DETAILED DESCRIPTION OF THE PREFERRED EMBODIMENT

Figure 1:
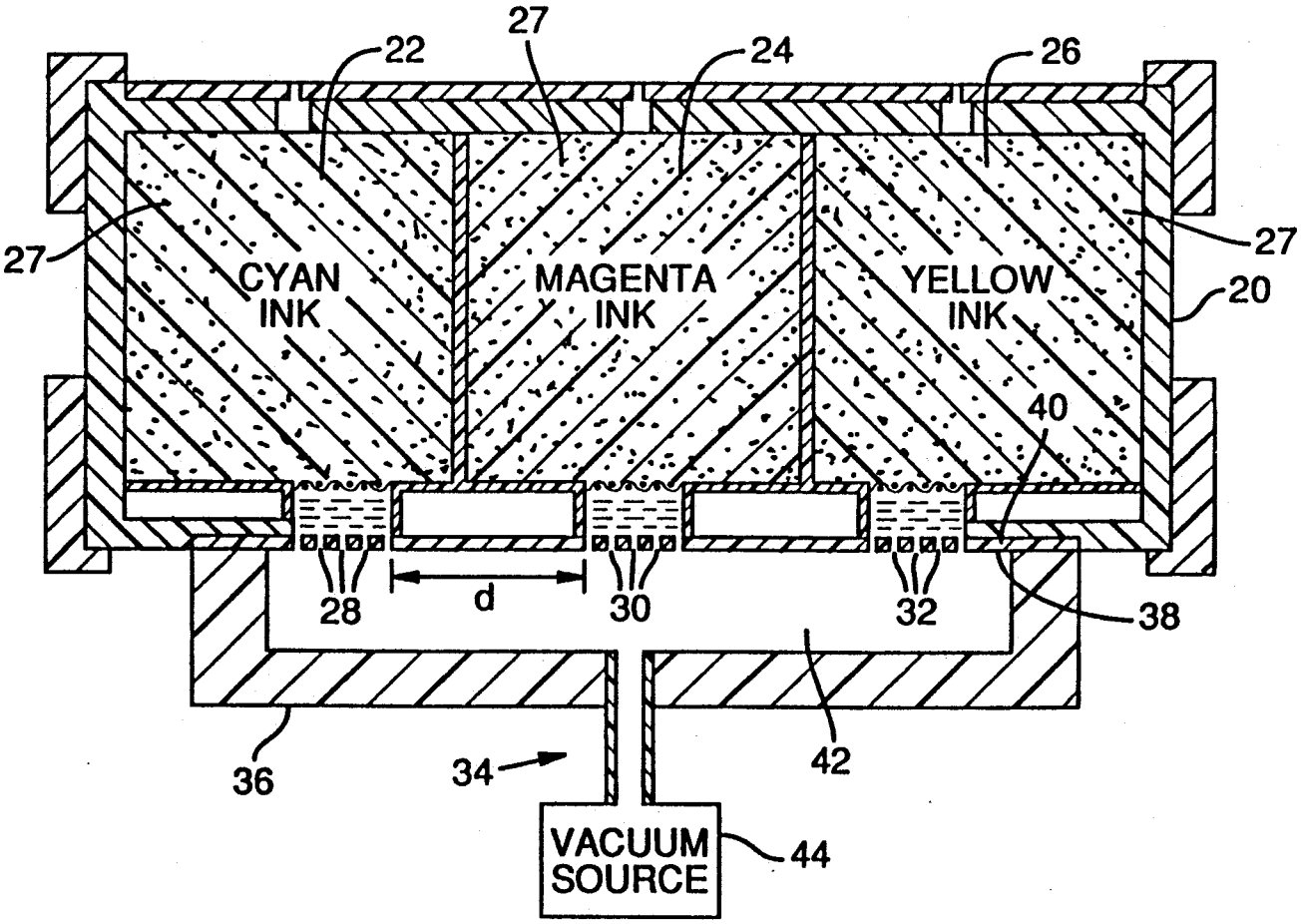
FIG. 1 PRIOR ART
FIG. 1 is a schematic cross-sectional diagram of a prior art system for priming a multi-color ink-jet pen.
Figure 2:
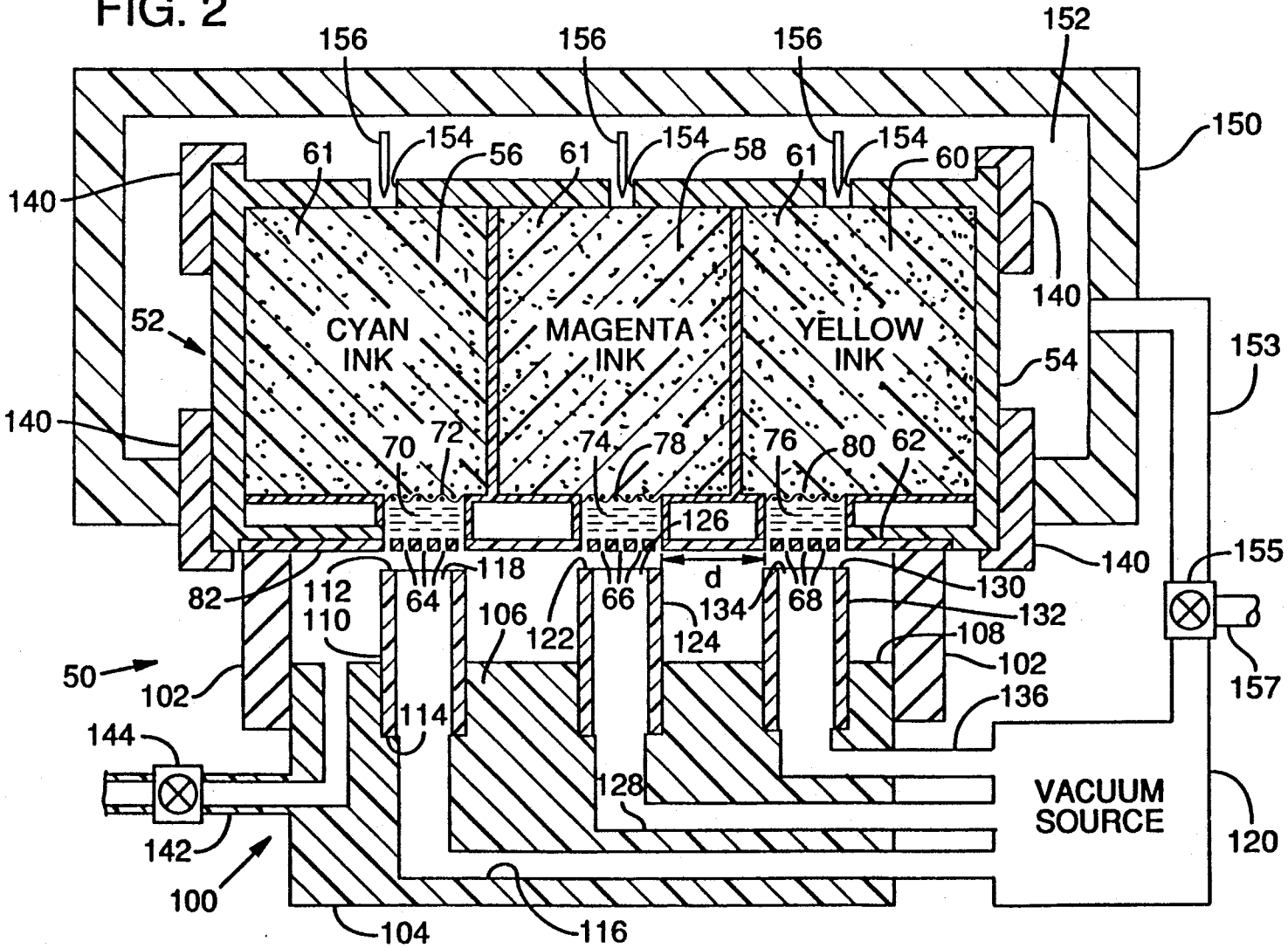
FIG. 2 is a schematic cross-sectional diagram of a preferred embodiment of an apparatus for priming a multi-color ink-jet pen in accordance with the present invention.

FIG. 2 is a schematic diagram of a priming apparatus 50 formed in accordance with the present invention for priming a conventional multi-color ink-jet pen 52. The pen includes a housing 54 that defines therein a cyan-ink compartment 56, a magenta-ink compartment 58, and a yellow-ink compartment 60. Each ink compartment is filled with open-cell foam 61 that is saturated with ink as described more fully below. An orifice plate 62 is mounted to the underside of the pen housing 54. It is noteworthy that the schematic diagram of FIG. 2 is not to scale, the size of the pen housing 54 and the compartments defined therein being shown substantially smaller, relative to the orifice plate 62, than that of a conventional pen 52.

The orifice plate 62 is fabricated by known means, such as electroforming. The plate 62 includes a set of orifices 64 formed therein and located to be in fluid communication with the cyan-ink supply compartment 56. Similarly, a second orifice set 66 is formed in the orifice plate 62 and located to be in fluid communication with the magenta-ink compartment 58, and a third set of orifices 68 is formed in the orifice plate 62 to be in fluid communication with the yellow-ink compartment 60.

The orifice sets 64, 66, 68 may comprise any of a number of individual orifices, although for illustrative purposes only five such orifices are depicted in each orifice set shown in FIG. 2. In one preferred embodiment, an orifice set may include as many as twenty-four orifices arranged in two parallel rows. The orifice sets are arranged to be very close together. For example, the minimum distance "d" (FIG. 2) between two orifice sets may be as little as 0.5 millimeters.

Each orifice set 64, 66, 68 has associated with it a print head mechanism, such as a conventional thermal-bubble, thin-film resistor type (not shown), which is controllable for ejecting ink out of any one or more orifices of a set of orifices.

A supply channel 70 resides between the orifice set 64 and the cyan-ink compartment 56. A filter 72, against which the foam 61 in the cyan-ink compartment 56 is compressed extends between the compartment 56 and the supply channel 70. Similarly, a supply channel 74 is defined between the magenta-ink compartment 58 and associated orifice set 66. A filter 78 extends across that channel 74. A third supply channel 76, across which a third filter 80 extends, is defined between the yellow-ink compartment 60 and associated orifice set 68.

As noted earlier, an ink-jet pen of the type described above will not operate unless there exists between the ink supply compartment and the orifice set a continuous path of ink. Accordingly, proper operation requires that each supply channel 70, 74, 76 be filled with ink and that no significant amount of air will be trapped between the ink supply and the orifice sets 64, 66, 68. The process of moving ink from the ink supply compartments to fill the supply channels is known as priming. The particulars of the preferred apparatus and process for priming the pen 52 are now discussed with reference to FIGS. 2–5.

The priming apparatus 50 generally includes a connector assembly 100, the primary components of which include a resilient seal member 102 that is mounted to a substantially rigid body 104. The body 104 is a block-shaped member having an upper surface 106 that extends in a plane generally parallel to the plane of the orifice plate outer surface 82 and that underlies all of the orifice sets 64, 66, 68 formed in the orifice plate 62.

The resilient seal member 102 is fastened to the periphery of the body 104 to protrude upwardly therefrom above the upper surface 106. Consequently, as the orifice plate 62 and the seal member 102 are brought together into a priming position, as shown in FIG. 2, there is defined between the body 104 and orifice plate 62 a priming chamber 108 that is completely enclosed on the sides by the seal member 102.

A suction tube 110 is mounted to the body 104 of the connector assembly 100 and arranged so that the upper end 112 of that tube 110 is disposed within the priming chamber 108 directly beneath the orifice set 64 and spaced a short distance or gap "G" (see FIG. 3) therefrom. The suction tube 110 is mounted to the body 104 so that the lower end 114 of the tube 110 is contiguous with an internal conduit 116 formed in the body 104. This arrangement provides fluid communication between the central opening 118 of the suction tube 110 and the vacuum conduit 116. The vacuum conduit 116 extends between the body 104 and a regulated vacuum source 120 for applying suction to the conduit 116 and, hence, to the connected suction tube 110.

Additional suction tube and vacuum conduit arrangements substantially identical to the suction tube 110 and vacuum conduit 116 arrangement just described are included in the priming apparatus 50 so that immediately beneath the orifice set 66 of the magenta-ink supply compartment 58 there is an upper end 122 of another suction tube 124 spaced a short distance G (see FIG. 3) from the outer surface 82 of the orifice plate 62. The central opening 126 of this suction tube 124 is in fluid communication with a discrete (that is, separate from vacuum conduit 116) vacuum conduit 128, which conduit 128 is connected to the vacuum source 120. The vacuum source 120 applies suction to the suction tube 124.

The upper end 130 of a third suction tube 132 is immediately beneath the orifice set 68 of the yellow-ink supply compartment 60. The central opening 134 of that suction tube 132 is in fluid communication with a discrete (that is, separate from conduits 116 and 128) vacuum conduit 136 that connects to the vacuum source 120 for applying suction to the internal opening 134 of the suction tube 132.

In the preferred embodiment, the pen housing 54 is mounted to a fixture 140 during the time the pen 52 is primed. The fixture 140 secures the pen housing 54 as the connector assembly 100 is moved into the priming position so that the seal member 102 contacts the underside of the pen in the region of the orifice plate 62 to define the sealed priming chamber 108 mentioned above.

The priming chamber 108 may be vented to ambient air (that is, when the apparatus 50 is in the priming position, FIG. 2) by a vent tube 142 that extends between ambient and the priming chamber 108. A valve 144 in the vent tube 142 is controlled by an operator for permitting or preventing fluid communication between the priming chamber 108 and ambient air. Accordingly, whenever the valve 144 is closed and the vacuum source 120 is activated, a partial vacuum will be established within the priming chamber 108 as fluid is drawn by the vacuum source 120 through the suction tubes 110, 124. 132. Opening the valve 144 substantially eliminates the partial vacuum in the priming chamber 108 as ambient air enters the priming chamber 108.

The priming operation of the present invention is preferably, although not necessarily, undertaken in conjunction with the operation by which the pen 52 is filled with ink. The operation for filling the pen is briefly described next.

During the fill operation, the entire pen 52, except for a top cap not shown in FIG. 2, is held by the fixture 140 substantially within a sealed container 150. The container 150 surrounds substantially all of the upper portion of the pen 52. The interior of the container 150 defines a fill chamber 152. The fill chamber 152 is in fluid communication with all of the ink supply compartments 56, 58, 60 as a result of the presence of fill apertures 154 formed in the upper part of the housing 54.

The fill chamber 152 is connected to the vacuum source 120 (or any other regulated vacuum source) via a conduit 153 for the purpose of removing air in the fill chamber 152 and supply compartments 56, 58, 60 during the ink filling operation. In this regard, it is desirable to remove from the interior of the foam 61 any trapped air that might hinder the dispersion of ink through the foam as the pen is filled.

Once a partial vacuum is established in the fill chamber 152 (hence, in ink compartments 56, 58, 60), a hollow needle 156 is injected into the center of the foam in each compartment and the appropriate color of ink is pumped through the needle to fill the foam compartment with ink.

Once the ink compartments 56, 58, 60 are filled with ink, the priming process commences. To this end, the operator closes vent valve 144 while the apparatus 50 is in the priming position (FIG. 2) The vacuum applied to the suction tubes 110, 124, 132 by the vacuum source 120 is, preferably, regulated so that the partial vacuum established within the priming chamber 108 will be that necessary for overcoming the capillarity of the foam 61, thereby to draw ink from the foam to fill each supply channel 70, 74, 76 and to force ink through each associated orifice set 64, 66, 68.

During the time the pen is filled with ink, the partial vacuum in the fill chamber 152 is substantially greater than (i.e., more negative relative to ambient) the partial vacuum established in the priming chamber 108. Accordingly, until the partial vacuum in the fill chamber 152 is reduced to a level below that in the priming chamber 108, ink will not flow toward the priming chamber 108. In a preferred embodiment of the invention, the partial vacuum in the fill chamber 152 is gradually reduced to a level less than that of the partial vacuum in the priming chamber 108, as described more fully below.

Figure 3:
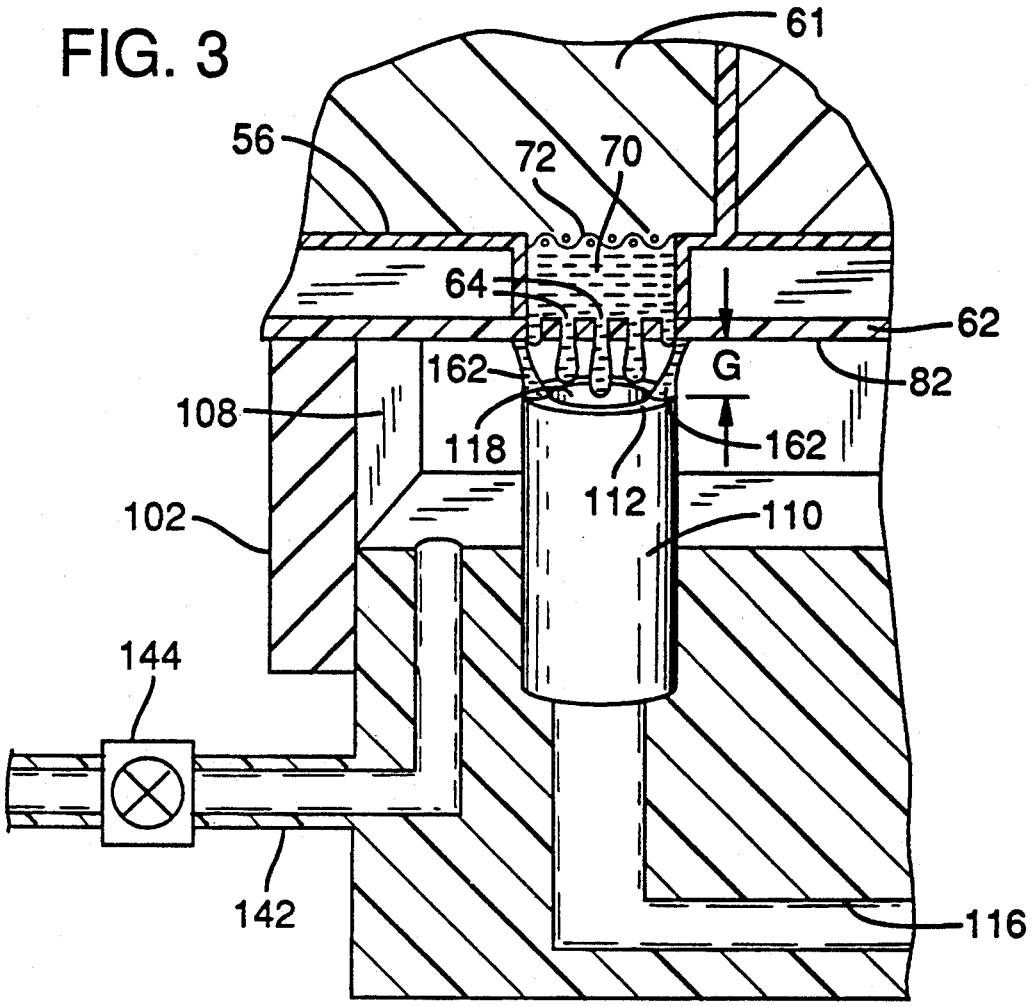
FIG. 3 is a schematic diagram depicting the behavior of ink at a single orifice set during the time the priming process in underway.

FIG. 3 is a diagram of ink behavior at the orifice set during the priming process; that is, during the time valve 144 in the priming chamber vent is closed and the suction is applied via conduit 116 to the suction tube 110. It is understood that the following portion of the description applies to the behavior of the ink occurring at all suction tubes 124, 132.

Ink 160 in the supply compartment 56 is drawn by the suction from the foam 61 through the filter 72 to fill the supply channel 70. From the supply channel 70, ink is drawn through the orifice set 64 and is eventually drawn into the central opening 118 of the tube from where it flows toward vacuum source 120 and is trapped and removed.

Figure 4:
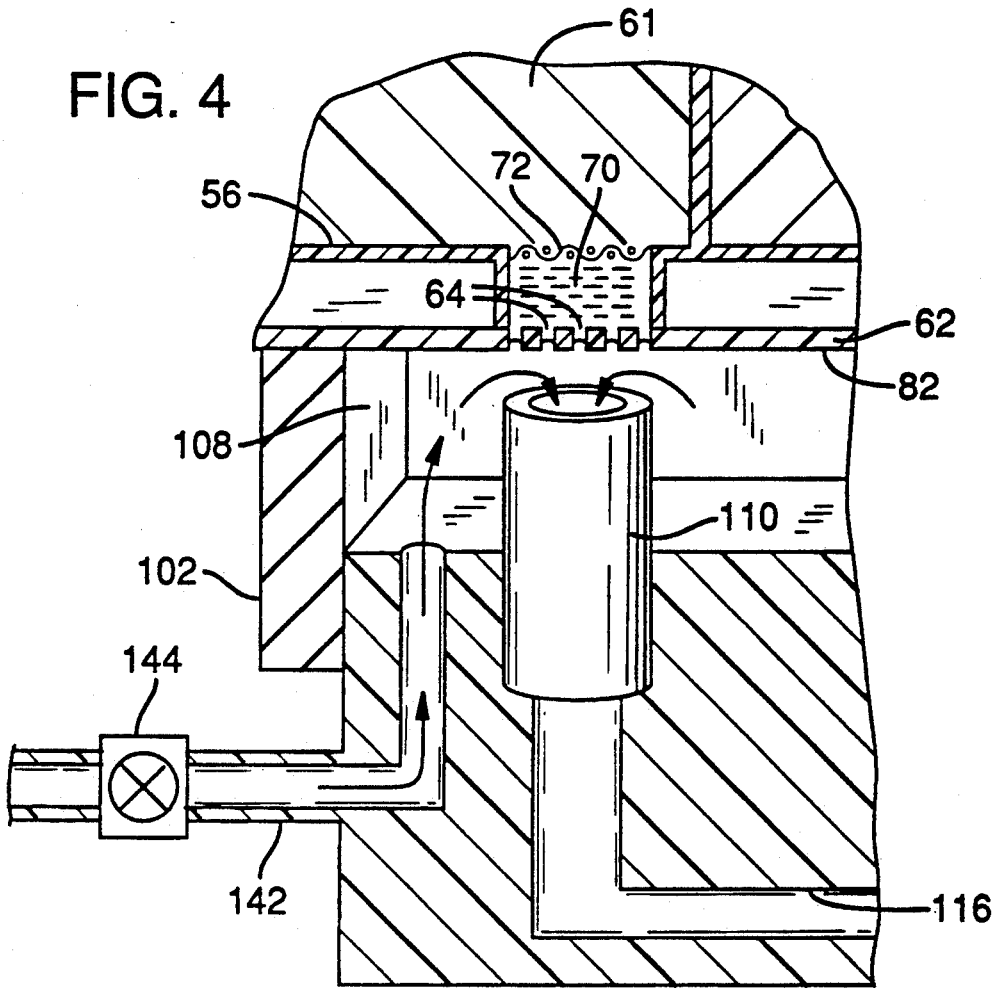
FIG. 4 is a schematic diagram depicting the behavior of ink at an orifice set at the completion of the priming process of the present invention.

The gap G between the upper end 112 and the surface 82 of the orifice plate 62 is small enough to ensure that the suction is communicated between the tube 112 and the orifice set 64. Moreover, the gap G between the tube 110 and orifice plate 62 provides a mechanism for removing any residual ink that may be present in the vicinity of the orifice set 64 at the conclusion of the priming process. In this regard, some of the ink 160 that is drawn from the supply channel 70 may form a liquid bridge 162 between the outer surface 82 of the orifice plate and the upper end 112 of the suction tube 110. In order to ensure that substantially none of this bridging ink 162 remains on the outer surface 82 of the orifice plate 62 (hence, being capable of flowing to and mixing with ink in an adjacent orifice set), the partial vacuum established in priming chamber 108 is rapidly reduced at the conclusion of the priming process by opening the valve 144 in the vent 142. Consequently, as shown in FIG. 4, air rushing through the vent tube 142, into the chamber 108 and into the suction tube 110 rapidly shears the ink bridges 162 so that substantially all of that ink 162 either enters the central opening 118 of the tube 110 or is drawn back into the individual orifices of the orifice set 64 to be held therein by the capillarity of the foam 61. In short, the configuration and operation of the priming apparatus 50 substantially eliminates the presence of residual ink on the orifice plate at the end of the priming process.

As mentioned earlier, the partial vacuum in the fill chamber 152 is gradually reduced (that is, made less negative relative to ambient air) to a level less than that of the partial vacuum of the priming chamber 108. The mechanism for gradually reducing the partial vacuum in the fill chamber 152 may include, for example, a bleed valve 155 that can be manually or automatically operated to gradually permit ambient air to enter the conduit 153 via stub 157, thereby, gradually reducing the suction applied to the fill chamber 152.

The effect of the gradual reduction of the partial vacuum in the fill chamber 152 is to minimize the amount of ink 160 that is removed from the pen during the time that the priming process is undertaken. In this regard, the time period (hereafter called the priming time $T_p$) during which the partial vacuum established in the priming chamber 108 is greater than the capillarity of the foam 61 is selected for ensuring that all orifices of all orifice sets are free of any trapped air. This priming time $T_p$ may be, for example, 1.0 to 4.0 seconds.

Figure 5:
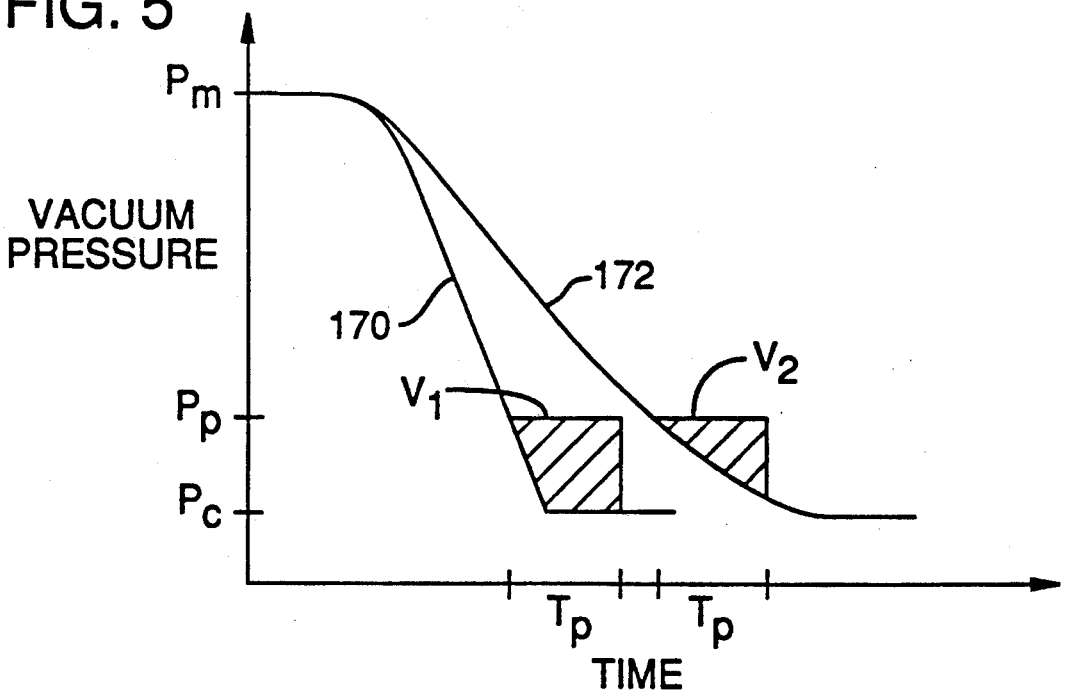
FIG. 5 is a graph depicting a preferred technique for regulating the ink supply compartment pressure change over time during a priming operation.

FIG. 5 graphically represents the effect of the gradual reduction of the fill chamber partial vacuum in reducing the amount of ink removed (hence, wasted) during priming. The ordinate of the graph represents vacuum pressure. The abscissa represents time, with the intervals $T_p$ representing priming time intervals $T_p$. The value $P_f$ represents the pressure in the fill chamber 152 during the ink filling operation. The value $P_p$ represents the vacuum pressure in the priming chamber 108 as established by the regulated vacuum source 120. The value $P_c$ represents the back pressure established by the foam capillarity, which back pressure must be overcome by the priming pressure for drawing ink from the foam through the associated orifice sets.

Line 170 of the graph in FIG. 5 depicts the relatively rapid reduction of the partial vacuum in fill chamber 152 that might occur when, for example, no bleed valve 155 were employed for gradual reduction of the chamber 152. Line 172 represents the relatively gradual reduction in the vacuum pressure in fill chamber 152 as occurs with the use of the bleed valve 155 of the present invention. Once the vacuum pressure in the fill chamber 152 is reduced to that below the pressure $P_p$ in the priming chamber 108, a volume of ink, hereafter referred to as a priming volume, will be removed from the fill compartment over a given priming time $T_p$.

Upon review of the graph of FIG. 5 it can be appreciated that the priming volume $V_1$ associated with a rapid reduction of the partial vacuum in the fill chamber 152 (Line 170) is substantially greater than the priming volume $V_2$ that occurs for the identical priming time $T_p$ when the fill chamber 152 is gradually reduced as indicated by line 172 of FIG. 5. Accordingly, it will be appreciated by one of ordinary skill in the art that the gradual reduction of the relative partial vacuums in the fill chamber 152 and priming chamber 108 (which gradual reduction is accomplished by the us of the bleed valve 155) permits priming of the pen while minimizing the amount of wasted ink.

Another efficient technique for minimizing ink waste during priming involves varying both the fill chamber partial vacuum and the priming chamber partial vacuum during the priming time $T_p$ for maintaining throughout that time $T_p$ a pressure differential $P_d$ just large enough for drawing ink from the ink compartments.

Figure 6:
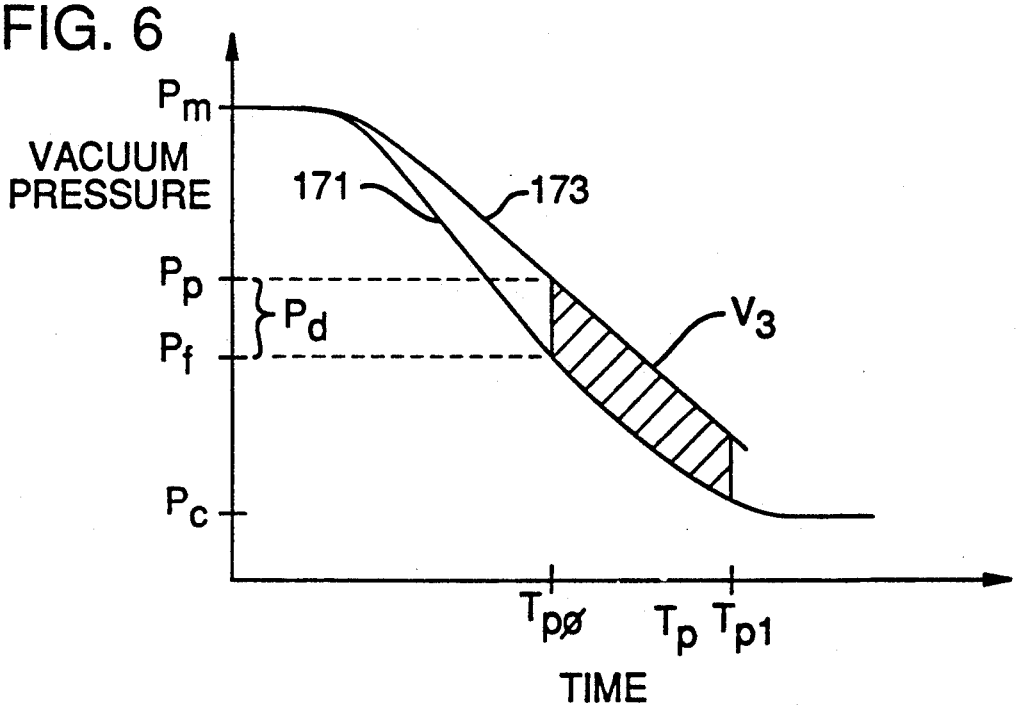
FIG. 6 is a graph depicting another preferred technique for regulating the ink supply compartment and priming chamber pressure change over time during a preferred priming operation.

With reference to FIG. 6, the vacuum source 120, which is connected to both the priming chamber 108 and the fill chamber 152 is controlled to simultaneously apply to both chambers 108, 152 a maximum partial vacuum $P_m$ during the filling process and before the priming process begins. Once the priming process begins, the volume of air flowing from the priming chamber 108 and fill chamber 150 to the vacuum source 120 is regulated to establish the above-mentioned differential $P_d$. In this regard, line 171 represents the controlled reduction of the partial vacuum in the fill chamber 150 and line 173 represents the controlled reduction of the partial vacuum in the priming chamber 108. At the beginning $T_{pb}$ of the priming time $T_p$, the vacuum pressure $P_p$ in the priming chamber 108 is greater by the differential amount $P_d$ than the vacuum pressure $P_f$ in the fill chamber 150. This differential $P_d$ is great enough to effect priming and is substantially maintained until the end $T_{p1}$ of the priming time $T_p$, at which time $T_{p1}$, the priming chamber partial vacuum is eliminated by venting that chamber to ambient as described above.

It can be appreciated that the use of the just described technique minimizes the volume of ink (that volume represented by area $V_3$ in FIG. 6) that is wasted during a given priming time $T_p$.

It is noteworthy that the priming process of the present invention was discussed as operable in conjunction with the pen filling operation. It will be appreciated, however, that the priming apparatus 50 of the present invention may be employed for priming the pen even after the pen is completely filled and capped.

While having described and illustrated the principles of the invention with reference to preferred embodiments and alternatives, it should be apparent that the invention can be further modified in arrangement and detail without departing from such principles. Accordingly, it is understood that the present invention includes all such modification that may come within the scope and spirit of the following claims and equivalents thereof.

We claim:

1. An apparatus for priming a pen that includes an orifice plate having a first set of orifices in fluid communication with a supply of first-color ink and a second set of orifices in fluid communication with a supply of second-color ink, the apparatus comprising:

a connector member movable to a priming position near the orifice plate and defining a single first chamber;

first and second tubular members mounted to the connector member and arranged so that the first tubular member terminates within the first chamber in closely spaced relation with the first set of orifices and the second tubular member terminates within the first chamber in closely spaced relation with the second set of orifices; and a vacuum source connected to the first and second tubular members for applying suction in both tubular members so that the suction in the first tubular member urges the first-color ink through the first set of orifices and the suction in the second tubular member urges the second-color ink through the second set of orifices.

2. The apparatus of claim 1 wherein the connector member includes a body and a seal member attached to the body, the seal member contacting the pen when the connector member is in the priming position, the seal member, plate, and body defining the first chamber in which the first and second tubular members terminate; and vent means operable for sealing the first chamber from ambient air thereby permitting a pressure reduction in the first chamber as suction is applied to the first and second tubular members.

3. The apparatus of claim 2 wherein the vent means is operable for placing the first chamber in fluid communication with ambient air while the connector member is in the priming position.

4. The apparatus of claim 3 wherein the vent means includes a valve and vent tube mounted to the connector member, the valve being openable for connecting the first chamber with ambient air and closable for sealing the first chamber from ambient air.

5. The apparatus of claim 2 further comprising:

a container to which the pen is mounted, the container being configured for defining a second chamber with which the supplies of first-color ink and second-color ink are in fluid communication, the vacuum source being connected to the second chamber for producing a partial vacuum in the second chamber; and control means for gradually reducing the partial vacuum in the second chamber as the suction is applied by the vacuum source to the first chamber.

6. The apparatus of claim 1 wherein the vacuum source is connected to the first and second tubular members by discrete conduits so that blockage of one of said conduits does not eliminate suction applied to the tubular member that is connected to another discrete conduit.

7. A priming apparatus for a pen that includes an orifice plate having a first set of orifices in fluid communication with a supply of first-color ink and a second set of orifices in fluid communication with a supply of second-color ink, the apparatus comprising:

a connector member positionable against the orifice plate to define a first chamber with which the first and second sets of orifices are in fluid communication;

a container for securing the pen, the container being configured for defining a second chamber with which the supplies of first-color ink and second-color ink are in fluid communication;

vacuum means for generating partial vacuum in the first and second chamber; and control means for gradually reducing the partial vacuum in the second chamber while the partial vacuum in the first chamber is maintained for urging first-color ink through the first set of orifices and for urging second-color ink through the second set of orifices.

8. The apparatus of claim 7 further comprising first and second tubular members mounted to the connector member and arranged so that the first tubular member terminates near the first set of orifices and the second tubular member terminates near the second of orifices; and a vacuum source connected to the first and second tubular members for applying suction in both tubular members so that the suction in the first and second tubular members generates the partial vacuum in the first chamber.

9. The apparatus of claim 8 further comprising vent means for rapidly venting the first chamber to ambient while the connector member is positioned against the orifice plate.

10. The apparatus of claim 8 wherein the vacuum source is connected by a conduit to the second chamber, the vacuum source generating the partial vacuum in the second chamber.

11. The apparatus of claim 10 wherein the control means includes a valve attached to the conduit for reducing the partial vacuum applied to the second chamber.

12. The apparatus of claim 8 wherein the first and second tubular members are connected to the vacuum source by discrete conduits so that blockage of one conduit does not eliminate suction applied to the tubular member that is connected to another discrete conduit.

13. A method of priming ink through first and second sets of orifices of an orifice plate of a pen that has a first-color ink stored in fluid communication with the first set of orifices and a second-color ink stored in fluid communication with the second set of orifices, the method comprising the steps of:

positioning an end of a first tubular member in closely spaced relation with the first set of orifices;

positioning an end of a second tubular member in closely spaced relation with the second set of orifices;

connecting the first and second tubular members to terminate within a common first chamber; and applying to the first and second tubular members suction for urging the first-color ink through the first set of orifices toward the end of the first tubular member and for urging the second-color ink through the second set of orifices toward the end of the second tubular member.

14. The method of claim 13, further comprising the step of sealing the first chamber from ambient so that suction applied to the tubular members creates a reduced pressure within the chamber.

15. A method of priming first and second sets of orifices of an orifice plate that has a first-color ink stored in fluid communication with the first set of orifices and a second-color ink stored in fluid communication with the second set of orifices, the method comprising the steps of:

defining a single first chamber with which the first and second sets of orifices are in fluid communication;

defining a second chamber with which the stored first-color ink and second-color ink are in fluid communication;

applying a partial vacuum to the first and second chambers; and gradually reducing the partial vacuum in the second chamber while maintaining the partial vacuum in the first chamber so that the partial vacuum in the first chamber begins to urge the first-color ink through the first set of orifices and the second-color ink through the second set of orifices.

16. The method of claim 15 further including the step of venting to ambient the first chamber after the first-color ink and the second-color ink moves through associated first and second set of orifices.

17. The method of claim 15 including the step of gradually reducing the partial vacuum in the first chamber at a rate relative to that of the second chamber to maintain during priming a predetermined differential between the partial vacuum in the first and second chambers.

* * * * *